US005484544A

United States Patent [19]

Dion Biro et al.

[11] Patent Number: 5,484,544

[45] Date of Patent: Jan. 16, 1996

[54] LUBRICATING COMPOSITION, PREPARATION PROCESS AND APPLICATIONS, PARTICULARLY AS AN ADDITIVE IN OILS

[76] Inventors: Guy Dion Biro, 48, avenue du Château, 94300 Vincennes; Renan de Bona Biro, 7, rue du Dôme, 75116 Paris, both of France

[21] Appl. No.: 170,356

[22] PCT Filed: Jul. 6, 1992

[86] PCT No.: PCT/FR92/00641

§ 371 Date: Apr. 20, 1994

§ 102(e) Date: Apr. 20, 1994

[87] PCT Pub. No.: WO93/01262

PCT Pub. Date: Jan. 21, 1993

[30] Foreign Application Priority Data

Jul. 5, 1991 [EP] European Pat. Off. ..... 91401865

[51] Int. Cl.[6] ..... C10M 171/00; C08J 3/09

[52] U.S. Cl. ..... 252/54; 252/58

[58] Field of Search ..... 252/54, 58

[56] References Cited

U.S. PATENT DOCUMENTS

| | | | |
|---|---|---|---|
| 4,127,491 | 11/1978 | Reick | 252/22 |
| 4,806,281 | 2/1989 | Huth | 252/58 |
| 5,160,646 | 11/1992 | Scheld | 252/58 |

FOREIGN PATENT DOCUMENTS

| | | |
|---|---|---|
| 0293427 | 12/1987 | European Pat. Off. . |
| 2359200 | 2/1978 | France . |
| 8804314 | 6/1988 | WIPO . |

*Primary Examiner*—Jacqueline V. Howard
*Attorney, Agent, or Firm*—Browdy and Niemark

[57] ABSTRACT

A substantially anhydrous lubricating composition containing solid particles of a fluorinated (co)polymer having a maximum size of 1 μm and coated with an ethoxylated nonylphenol having 10–12 ethylene oxide molecules. A preparation method is also provided.

26 Claims, No Drawings

LUBRICATING COMPOSITION, PREPARATION PROCESS AND APPLICATIONS, PARTICULARLY AS AN ADDITIVE IN OILS

FIELD OF THE INVENTION

The present invention relates to a lubricating composition, its preparation process and its applications, particularly as an additive in oils.

BACKGROUND OF THE INVENTION

The basic oils formulated by oil companies for use as lubricants are monograde oils. The majority of engines such as explosion, gasoline or diesel engines for cars for example, use multigrade oils.

Additives must be incorporated into these monograde oils to obtain multigrade oils after mixing.

These additives, insoluble or non-miscible in oils, are subjected sulphonation reactions in order to be solubilized in the oils to which they are added. With ageing, the oils release acids which corrode engines, more particularly stationary engines.

To avoid corrosion of engines, more particularly of stationary engines, it is thus necessary to increase the frequency of changes or to somehow protect the metal surfaces against corrosion by acids released from the oils.

Moreover, when engines remain unused for a certain period, numerous metal pieces dry out completely, i.e. there is no longer any lubricating fluid film between the metal pieces customarily in motion, and they are no longer lubricated at all at the start of the setting in motion of the engine and for a certain period; a metal-metal contact is then established.

It would thus be desirable to formulate a greasing oil avoiding the drying out of these metal surfaces or at least allow the coating of the metal pieces with a layer of solid lubricant serving as lubricant at the start of the setting in motion of the engine. Such a solid lubricant should also be fixed on the totality of the metal surfaces to be lubricated.

French patent application no. 2 359 200 describes a hybrid lubricant dilutable in a conventional fluid greasing oil, comprising a colloidal aqueous dispersion of polytetrafluoroethylene particles, a neutralizing and stabilizing agent, a carrier fluid lubricating oil incorporated in the stabilized dispersion to form with it an emulsion, which emulsion includes a dispersing agent and finally a wetting agent added to the emulsion and endowed with affinity vis-a-vis rubbing surfaces so as to predispose them to be impregnated by the said particles and fuse with them to form a superficial lubricating layer.

However, the hybrid lubricant uses an aqueous dispersion. The presence of water is prejudicial to the lubricating effect of oils, above all at the high temperatures where it is vaporized, involving difficulties of circulation in its circuit.

European patent no. 0 293 427 relates to a process for producing a dispersion of polytetrafluoroethylene for use as a lubricating oil or as an additive to the latter. In this process, a non-ionic surface agent is fixed to the polytetrafluoroethylene particles by heat treatment in several zones or stages of decreasing temperatures including a first zone at very high temperature, the first high temperature being prejudicial to the quality of the oil.

SUMMARY OF THE INVENTION

It would be desirable to have available a lubricating composition for use as a lubricating oil or as an additive to the latter in which particles of fluorinated (co)polymer would be fully miscible in the fluid in which they would be in stable suspension, without changing the basic characteristics, without fear of release or of decantation of the said particles in the fluid.

This is why the subject of the present application is a lubricating composition, characterized in that it contains solid particles of fluorinated (co)polymer of a size less than or equal to 1 μm coated with an ethoxylated nonylphenol having 10–12 ethylene oxide molecules and in that it is substantially anhydrous.

DETAILED DESCRIPTION OF EMBODIMENTS

Preferred compositions according to the invention are compositions characterized in that the particles of fluorinated (co)polymer are coated with a stable saturating quantity of ethoxylated nonylphenol.

Among the compositions according to the invention, use is preferably made of those in which the fluorinated (co)polymer is polytetrafluoroethylene, and those in which the ethoxylated nonylphenol comprises 11 ethoxyl molecules. In other preferential conditions, the ratio by weight of ethoxylated nonylphenol to fluorinated polymer is approximately 2 to 1 in the case where the fluorinated polymer is polytetra- fluoroethylene and of ethoxylated nonylphenol has 11 ethoxyl molecules.

The subject of the present invention is also a lubricant characterized in that it contains a lubricating composition as defined above.

The subject of the present application is also a process for preparing a lubricating composition containing particles of fluorinated (co)polymer in suspension characterized in that substantially anhydrous particles of the fluorinated (co)polymer of a size less than or equal to 1 μm are treated with the help of an approximately double volume of an ethoxylated nonylphenol with 10, 11 or 12 molecules of ethoxy, itself likewise substantially anhydrous, under stirring and anhydrous atmosphere, to obtain the expected lubricating composition.

The fluorinated (co)polymer can be a fluorinated resin chosen from among fluorinated polymers and copolymers, perfluoroalcoxylated alkonylated (co)polymers, partially fluorinated (co)polymers, preferably perhalogenated. These (co)polymers can be used alone or mixed. Mention can be made in particular of Teflon® (PTFE) essentially composed of tetrafluoroethylene. Mention can also be made of Teflon FEP®, a tetrafluoroethylene-hexafluoropropylene copolymer. Mention can likewise be made of Teflon PRPFA® which is a perfluorinated alkoxylated polymer. However, PTFE is preferred.

The particles of the fluorinated polymer or (co)polymer must be of a small size, i.e. less than 2μm, and preferably less than or equal to 1 μm. The particles must be substantially anhydrous, i.e. their hygrometry must be less than 1%, in particular less than 0.5% and advantageously less than 0.2%.

The particles can be made substantially anhydrous by warming them for a certain time, for example 24 hours and preferably approximately 48 hours or more, above the ambient temperature, for example 10° C. above the latter.

The particles used preferably have a relative density of approximately 0.5.

The ethoxylated nonylphenol used is also substantially anhydrous. This anhydrous character can be conferred by a heat treatment such as that described above for the particles of fluorinated (co)polymer. The relative density of the hydrolyser is approximately 1.04.

The fluorinated (co)polymer is mixed under stirring with the ethoxylated nonylphenol. Ca. 1.2 volume of ethoxylated nonylphenol is advantageously used per 1 volume of fluorinated (co)polymer. The stirring is preferably carried out in a centrifugal Vortex stirrer, advantageously including a two-stage turbine and central two-way aspiration.

The diameter of the turbine is preferably one third of that of the vessel. The tangential speed at the periphery of the turbine is preferably 15 to 30 m/s and advantageously 20 to 24 m/s.

The radial axis of the turbine is advantageously situated approximately a quarter of the way from the bottom of the total height of liquid.

However, any operational condition allowing the particles to perform 3 to 5 and preferably 4 revolutions per minute is usable.

When the fluorinated (co)polymer is added to the ethoxylated nonylphenol, this operation is preferably performed regularly and rapidly. For example, for a total weight of fluorinated (co)polymer and ethoxylated nonylphenol of 500 kg, the fluorinated co(poly)mer is added in two minutes at a regular feed rate. The stirring of the mixture can be maintained for from 30 minutes to an hour and preferably from 35 to 45 minutes, in particular ca. 40 min.

The product obtained at the end of the process has the appearance of an adhesive and thixotropic thick paste which can for example be extended with the addition of approximately 15% of monograde, neutral, basic mineral oil. This extended composition can be, i.e. poured The transvasable composition is miscible in the lubricating oil. The composition is not soluble in oils and thus has the advantage of maintaining the original properties for lubricating oils without changing them by adding its own. The transvasable solution can be mixed in the lubricating oil intended for gasoline, diesel, two-stroke engines, for hydraulic, mechanical or automatic transmission systems, or to reducers etc. The composition according to the present invention is particularly effective in the case of oils which travel in a circuit.

For its use as a lubricant, the usable dosage is ca. 8 grams of a transvasable composition extended as indicated above (with 15% mineral oil) per liter of liquid lubricant.

The applications are in particular the following:

First of all, a pre-dosage is carried out which involves mixing the transvasable composition with a quantity of oil. By way of example, in the case of or ready-to-use form, 15 grams of transvasable composition in solution in 0.8 litres of oil, i.e. a liquid lubricant in concentrate form, containing about 1.8% by volume of said (co)polymer particles coated with said ethoxylated nonylphenol in oil; can be added to 5 litres of oil of a grade conforming to that which is recommended by a car manufacturer for example to give a concentration of the lubricant composition of the treated (co)polymer particles in the oil of about 0.26%.

The thixotropic thick paste obtained through use of the process can also be incorporated in a grease (without incorporation of mineral oil). The thus-modified grease has the advantage, as in the case of engines or transmission systems, after prolonged immobilization, of avoiding the drawbacks of dry contacts between metals. The same applies to plain bearings, above all because of the small surfaces in contact, for ballbearings, bearings on which, during start-ups, the tearing away of metal feared by specialists is avoided.

Thanks to the use of the lubricating composition according to the invention in an explosion engine, running becomes progressively smoother as the treatment produces its effects. Starting becomes easier, engine wear is slowed down, some standards are re-established, in particular the compression ratios come into balance and return to normal, and segments that may have been stuck together by residues become unstuck and once again perform their role of tightness and stoichiometric stability, avoiding the rises of oil in combustion chambers and the projection of fuel into the oil.

Thanks to the appropriate granulometry of the particles of fluorinated (co)polymer, particularly of the polytetrafluoroethylene type, these easily pass through the oil filter without clogging.

Finally, the levels of unburned hydrocarbons and of carbon oxides, particularly carbon monoxide, are reduced, thus reducing atmospheric pollution.

EXAMPLE 1

333 kg of micronized polytetrafluoroethylene whose particle size is of the order of 6.5 μm marketed by ICI under the reference F170 and kept at a temperature of 30° C. beforehand, are poured steadily in two minutes at the centre of the turbine into 660 kg of ethoxylated nonylphenol with 11 molecules of ethylene oxide marketed by Sidobre Sinova under the reference OP 11 also raised to a temperature of 30° C. for 40 minutes stirred in a centrifugal Vortex-type mixer under the following conditions:

The diameter of the turbine represents approximately one third of the diameter of the vessel, the turbine is situated half-way up the ethoxylated nonylphenol, the tangential speed at the periphery of the turbine being set at approximately 22 m/s and the height of the turbine being such that each particle performs approximately 4 revolutions per minute.

Stirring is continued for 40 minutes at a temperature of 30° C. and the expected lubricating composition is obtained.

In the composition obtained, the polytetrafluoroethylene particles have a size less than or equal to 1 μm, these particles are miscible in all proportions with both commercial multigrade and with monograde oils. The composition substantially no longer contains free ethoxylated nonylphenol, i.e. less than 0.1%.

The final density of the polytetrafluoroethylene particles is approximately 0.82 as against 0.5 for the original polytetrafluoroethylene particles.

As the density of the particles is extremely close to that of multigrade commercial oils, they can remain in stable suspension for very long periods of time.

EXAMPLE 2

Transvasable composition

The above composition is diluted with 15% of basic monograde mineral oil, SAE 30 to obtain a transvasable composition.

EXAMPLE 3

Transvasable composition

The above composition is diluted with 15% of basic monograde mineral oil, SAE 30 to obtain a transvasable composition.

We claim:

1. Lubricating particles comprising solid particles of fluorinated (co)polymer of a size less than or equal to 1 μm coated with an ethoxylated nonylphenol having 10 to 12 ethylene oxide molecules and in that it is substantially anhydrous and miscible with lubricating oil.

2. Particles according to claim 1, wherein the particles of fluorinated (co)polymer are coated with a stable saturating quantity of ethoxylated nonylphenol.

3. Particles according to claim 1 wherein the fluorinated (co)polymer is polytetrafluoroethylene.

4. Particles according to claim 1, wherein the ethoxylated nonylphenol comprises 11 molecules of ethoxyl.

5. Particles according to one of claim 1, wherein the ratio by weight of ethoxylated nonylphenol to fluorinated polymer is approximately 2 to 1 in the case of polytetrafluoroethylene, and of ethoxylated nonylphenol with 11 ethoxyl molecules.

6. Lubricant comprising a lubricating oil and lubricating particles as defined in claim 1.

7. Process for preparing lubricating particles containing particles of fluorinated (co)polymer in suspension, comprising mixing substantially anhydrous particles of the fluorinated (co)polymer of a size less than or equal to 1 μm with an approximately double volume of an ethoxylated nonylphenol with 10, 11 or 12 molecules of ethoxy itself likewise substantially anhydrous, under stirring and anhydrous atmosphere, to obtain said lubricating particles.

8. Process according to claim 7, characterized in that the fluorinated (co)polymer is polytetrafluoroethylene.

9. Process according to claim 7, characterized in that the fluorinated (co)polymer and the ethoxylated nonylphenol are raised to a temperature above the ambient temperature before mixing.

10. Process according to claim 7 characterized in that ca. 1.7 volumes of ethoxylated nonylphenol are used per 1 volume of fluorinated (co)polymer.

11. Process according to claim 7, characterized in that stirring is carried out in a centrifugal vortex stirrer.

12. Process according to claim 11, characterized in that stirring is maintained for approximately 40 minutes for four revolutions of the particles per minute.

13. Particles according to claim 2, wherein the fluorinated (co)polymer is polytetrafluoroethylene.

14. Particles according to claim 2, wherein the ethoxylated nonylphenol comprises 11 molecules of ethoxyl.

15. Particles according to claim 3, wherein the ethoxylated nonylphenol comprises 11 molecules of ethoxyl.

16. Lubricant comprising lubricating particles as defined in claim 2 and a lubricating oil.

17. Lubricant comprising lubricating particles as defined in claim 3 and a lubricating oil.

18. Lubricant comprising lubricating particles as defined in claim 4 and a lubricating oil.

19. Lubricant comprising lubricating particles as defined in claim 15 and a lubricating oil.

20. Process according to claim 8, wherein ca. 1.7 volumes of ethoxylated nonyphenol are used per 1 volume of fluorinated (co)polymer.

21. Particles according to claim 1, wherein said ethoxylated nonylphenol comprises 10 molecules of ethoxyl.

22. Particles according to claim 21, wherein said fluorinated (co)polymer is polytetrafluoroethylene.

23. A lubricant according to claim 16, in the form of a liquid lubricant in concentrate form, wherein said fluorinated copolymer is polytetrafluoroethylene and said ethoxylated nonylphenol comprises 10 or 11 molecules of ethoxyl, and wherein said liquid lubricant concentrate comprises predominantly mineral oil containing approximately 1.8% by volume of said lubricating particles.

24. Particles according to claim 2, wherein the ethoxylated nonylphenol comprises 10 molecules of ethoxyl.

25. A lubricating oil according to claim 16, in ready-to-use form, wherein said fluorinated copolymer is polytetrafluoroethylene and said ethoxylated nonylphenol comprises 10 or 11 molecules of ethoxyl, and wherein said lubricant comprises predominantly mineral oil containing approximately 0.26% by volume of said lubricating particles.

26. A process according to claim 7, wherein said ethoxylated nonylphenol comprises 10 molecules of ethoxyl.

* * * * *